US006612592B1

(12) United States Patent
Soo

(10) Patent No.: US 6,612,592 B1
(45) Date of Patent: Sep. 2, 2003

(54) SKATE WITH A SIZE-ADJUSTABLE BOOT

(76) Inventor: Mike Soo, No. 931, Chung Shan Road, Jen Teh Shiang, Tainan Hsien (TW)

( * ) Notice: Subject to any disclaimer, the term of this patent is extended or adjusted under 35 U.S.C. 154(b) by 0 days.

(21) Appl. No.: 10/112,739

(22) Filed: Apr. 2, 2002

(51) Int. Cl.[7] ..... A63C 1/26; A43B 3/26

(52) U.S. Cl. ..... 280/11.16; 280/11.26; 280/11.27; 36/97

(58) Field of Search ..... 280/11.26, 11.12, 280/11.15, 11.16, 11.221, 11.27; 36/115, 97

(56) References Cited

U.S. PATENT DOCUMENTS 3,309,098 A * 3/1967 Parker ..... 280/11.26
4,684,140 A * 8/1987 Olivieri ..... 280/11.26
5,400,484 A * 3/1995 Gay ..... 280/11.26
5,484,149 A * 1/1996 Lee ..... 280/11.26
6,045,144 A * 4/2000 Wong ..... 280/11.26
6,276,697 B1 * 8/2001 Lin ..... 280/11.26
6,547,261 B2 * 4/2003 Gorza et al. ..... 280/11.26

* cited by examiner

*Primary Examiner*—Brian L. Johnson
*Assistant Examiner*—Jeffrey J. Restifo
(74) *Attorney, Agent, or Firm*—Rosenberg, Klein & Lee

(57) ABSTRACT

A skate includes a base, an adjusting member, and a boot including a front portion and a rear portion. The front portion is provided on a front portion of an upper side of the base. The rear portion is secured in place when the adjusting member is in its initial position. When the adjusting member is pushed, the rear portion is adjustable along a longitudinal direction of the base.

4 Claims, 5 Drawing Sheets

SKATE WITH A SIZE-ADJUSTABLE BOOT

BACKGROUND OF THE INVENTION

1. Field of the Invention

The present invention relates to a skate with a size-adjustable boot to suit various users' feet sizes.

2. Description of the Related Art

A typical skate includes a base having an underside to which a blade or rollers are attached and an upper side to which a boot is fixed. The boot is generally made of plastic material for protecting the user's foot from external impact. A lace or buckle is provided on the boot. Lining is usually provided inside the boot for protecting the user's foot from being in friction contact with the plastic boot. Users of the skates are often teenagers that are still growing. Thus, the fixed boot would be too small after a period of time. Skates with an adjustable boot have been proposed, but the adjustment of the size of the boot is troublesome, as the user has to detach screws and nuts before adjustment and reassemble the screws and nuts after assembly. Further, the design allowing adjustment of the size of the boot is too complicated and thus adversely affects the structural strength of the skate.

SUMMARY OF THE INVENTION

An object of the present invention is to provide a skate with a size-adjustable boot to suit various users' feet sizes.

A skate in accordance with the present invention comprises a base, an adjusting member, and a boot. A mounting section is defined in a rear portion of an upper side of the base. The mounting section includes two wings and a longitudinal groove between the wings. The longitudinal groove includes a receiving section in a front end thereof. Two lateral walls defining the longitudinal groove includes aligned first and second holes that are communicated with the receiving section.

The adjusting member includes a first end partially received in the first hole, a second end received in the second hole, and an intermediate portion received in the receiving section. The first end of the adjusting member includes a recessed portion, and a toothed portion is formed on the intermediate portion of the adjusting member. A spring is mounted around the second end of the adjusting member for returning the adjusting member to its initial position. A screw is attached to the second end of the adjusting member for restraining returning movement of the adjusting member.

The boot comprises a front portion and a rear portion. The front portion is provided on the upper side of the base and includes an open rear end located in a front end of the mounting section. A slot is defined between a bottom of the open rear end and each of the wings.

The rear portion of the boot is mounted to the mounting section of the base and adjustable along a longitudinal direction of the base. The rear portion of the boot includes an open front end for embracing the rear end of the front portion of the boot, thereby forming a boot. The rear portion of the boot further includes two slide grooves in an underside thereof for respectively, slidingly receiving the wings of the base. The rear portion of the boot further includes a rack received in the longitudinal groove and located between the slide grooves. The rack includes a plurality of teeth for engaging with the toothed portion of the adjusting member.

When the adjusting member is in its initial position, the toothed portion of the adjusting member is engaged with the teeth of the rack, thereby securing the rear portion of the boot in place. When the adjusting member is pushed, the toothed portion of the adjusting member is disengaged with the teeth of the rack, thereby allowing the rear portion of the boot to move along the longitudinal direction of the base.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
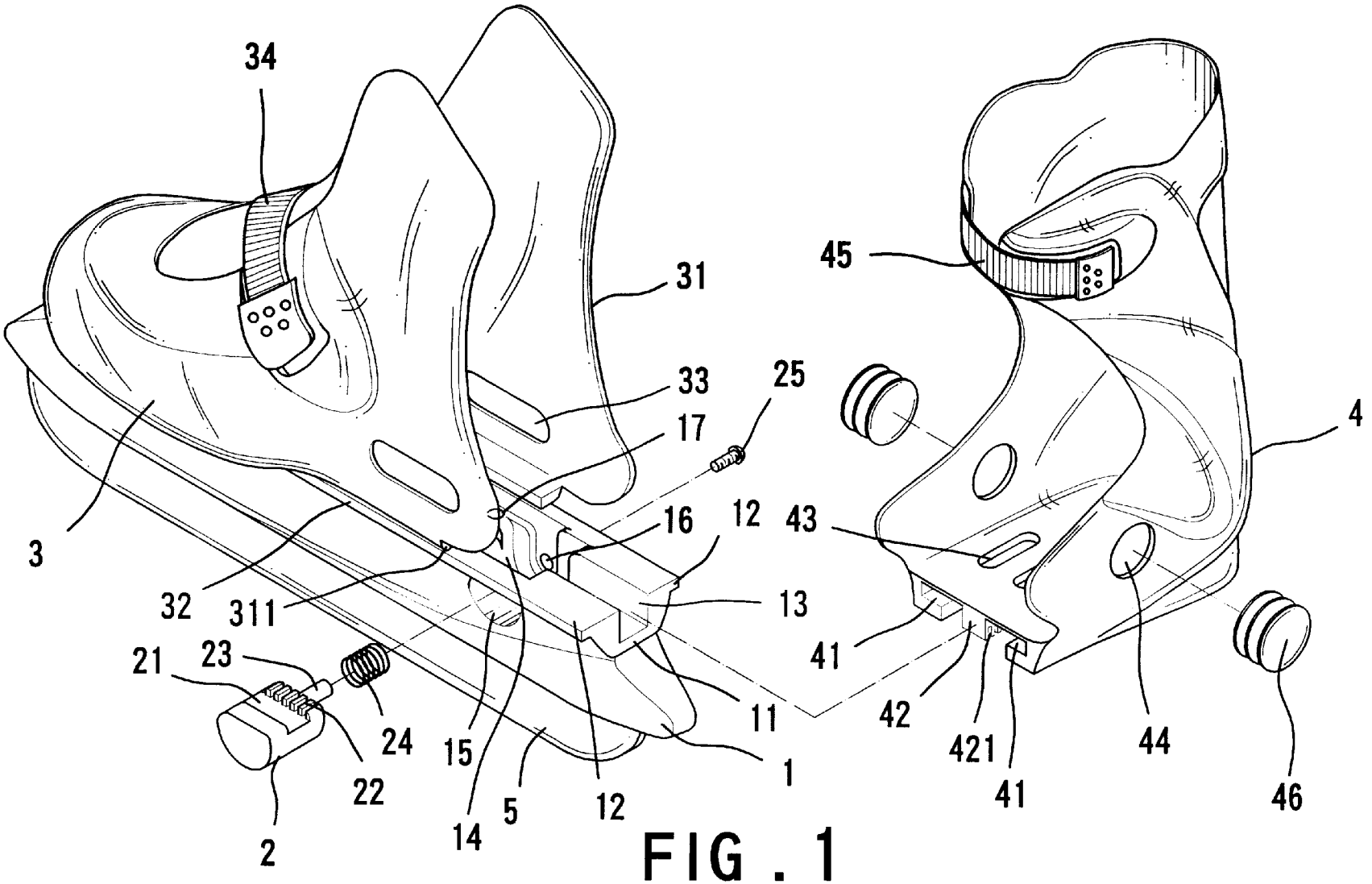
FIG. 1 is an exploded perspective view of a skate with a size-adjustable boot in accordance with the present invention.
Figure 2:
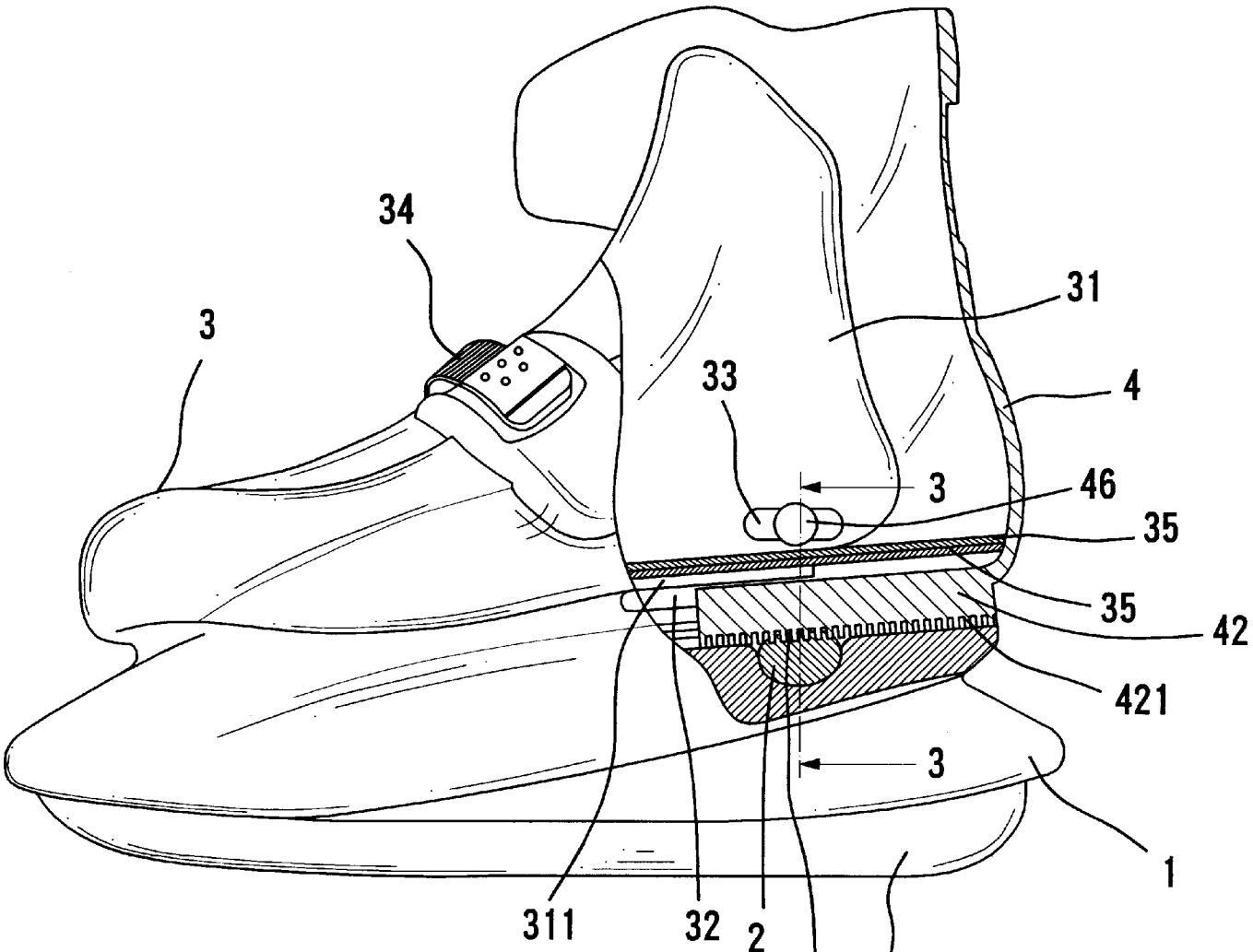
FIG. 2 is a perspective view, partly sectioned, of the skate in accordance with the present invention.

Referring to FIGS. 1 and 2, a skate in accordance with the present invention generally comprises a base 1, an adjusting member 2, and a boot. The boot includes a front portion 3 and a rear portion 4. The base 1, the front portion 3 of the boot, and the rear portion 4 of the boot are made of rigid plastic material. A blade or rollers are attached to an underside of the base 1. In this embodiment, a blade 5 is attached to the underside of the base 1.

The base 1 includes a mounting section 11 in a rear portion of an upper side thereof. The mounting section 11 includes two wings 12 and a longitudinal groove 13 between the wings 12. The longitudinal groove 13 is defined by two lateral walls (not labeled) and includes an enlarged receiving section 14 at a front end thereof. One of the lateral walls includes a first hole 15 aligned with the receiving section 14, and the other lateral wall includes a second hole 16 aligned with the first hole 15 and the receiving section 14.

Figure 3:
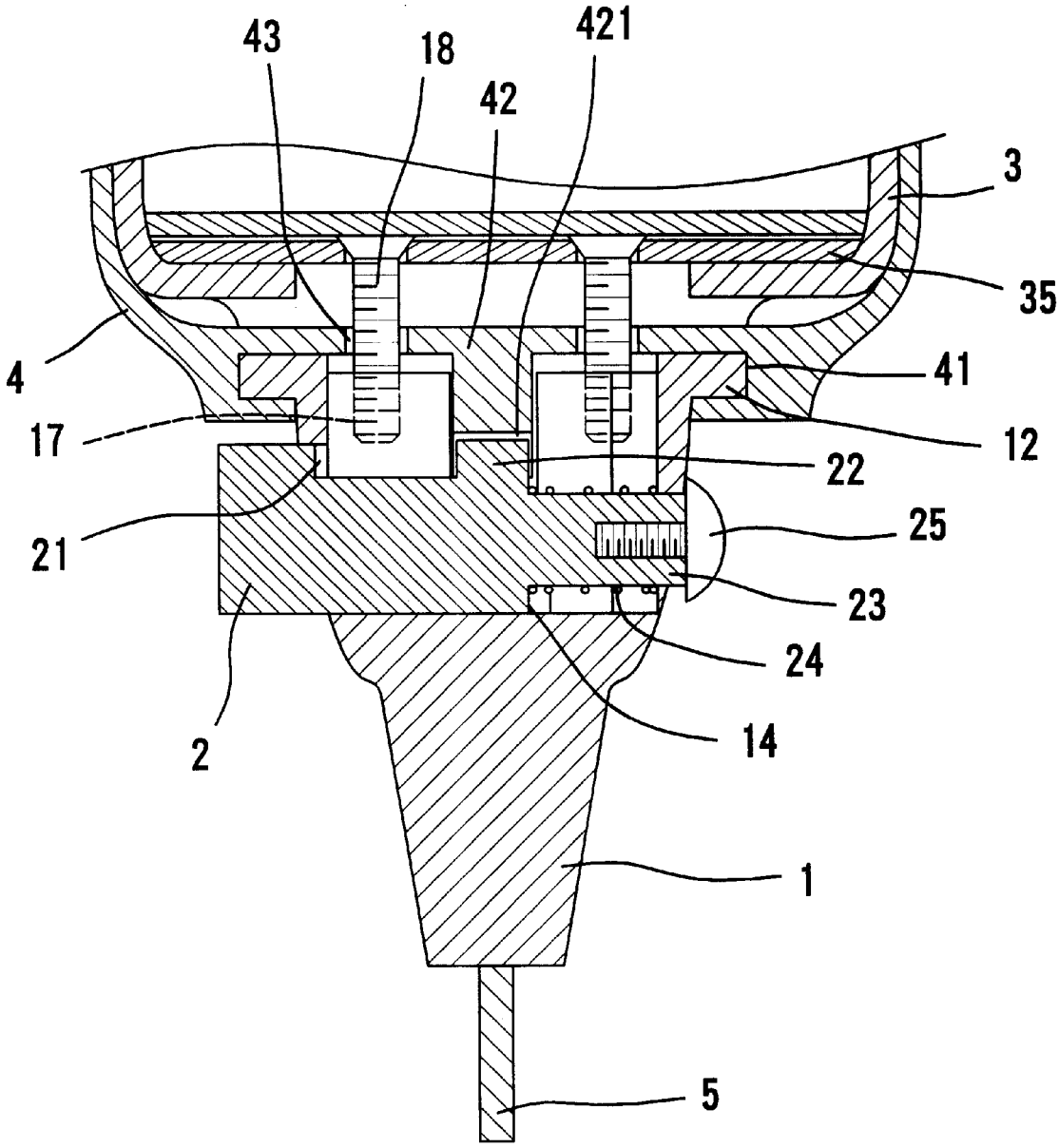
FIG. 3 is a sectional view taken along plane 3—3 in FIG. 1.

The adjusting member 2 is inserted into the second hole 16 through the first hole 15 and the receiving section 14, best shown in FIG. 3. As illustrated in FIGS. 1 and 3, the adjusting member 2 includes a recessed portion 21 in an end thereof that is received in the first hole 15. A screw 25 is attached to the other end 23 of the adjusting member 2 that is received in the second hole 16. A toothed portion 22 is formed on an intermediate portion of the adjusting member 2 that is received in the receiving section 14. A spring 24 is mounted around the other end 23 of the adjusting member 2 with a first end of the spring 24 being attached to an end face (not labeled) of the toothed portion 22 and with a second end of the spring 24 being attached to an inner face of one of the lateral walls defining the longitudinal groove 13, best shown in FIG. 3. As illustrated in FIG. 3, the end of the adjusting member 2 is partially exposed outside the first hole 15, allowing a user to push it. The spring 24 returns the adjusting member 2 to its initial position shown in FIG. 3 after the pushing force is released, and the screw 25 restrains the returning movement of the adjusting member 2.

The front portion 3 of the boot is integrally formed on the upper side of the base 1 by means of injection molding with an open rear end 31 of the front portion 3 being located in a front portion of the mounting section 11. A slot 32 is defined between a bottom 311 of the open rear end 31 and each wing 12. Further, the open rear end 31 of the front portion 3 is in the form of two parallel walls having aligned slots 33 defined therein. A buckle 34 is provided on the front portion 3 of the boot, and at least one sole 35 is mounted in the front portion 3 of the boot.

The rear portion 4 of the boot is open in a front end thereof for embracing the open rear end 31 of the front portion 3 of the boot, thereby forming a boot. An underside of the rear portion 4 includes two slide grooves 41 for respectively receiving the wings 12 of the mounting section 11. A rack 42 is mounted to the underside of the rear portion 4 and located between the slide grooves 41. The rack 42 is received in the longitudinal groove 13 and includes a plurality of teeth 421 on an underside thereof. Further, the front open end of the rear portion 4 includes two parallel walls having aligned holes 44, a guide member 46 being mounted in each hole 44. Further, two spaced longitudinal slots 43 are defined in the rear portion 4 of the boot. A buckle 45 is provided on an upper end of the rear portion 4 of the boot.

In assembly, as illustrated in FIGS. 2 and 3, the slide grooves 41 of the rear portion 4 are engaged with the wings 12 of the mounting section 11 until the rear portion 4 reaches the slots 32 of the front portion 3 of the boot. Thus, the rear portion 4 of the boot is attached to the rear of the front portion 3 of the boot. The adjusting member 2 is mounted into the receiving section 14 in the above-mentioned manner. The toothed portion 22 of the adjusting member 2 meshes with the teeth 421 of the rack 42. Thus, the rear portion 4 of the boot is securely engaged on the base 1.

Figure 4:
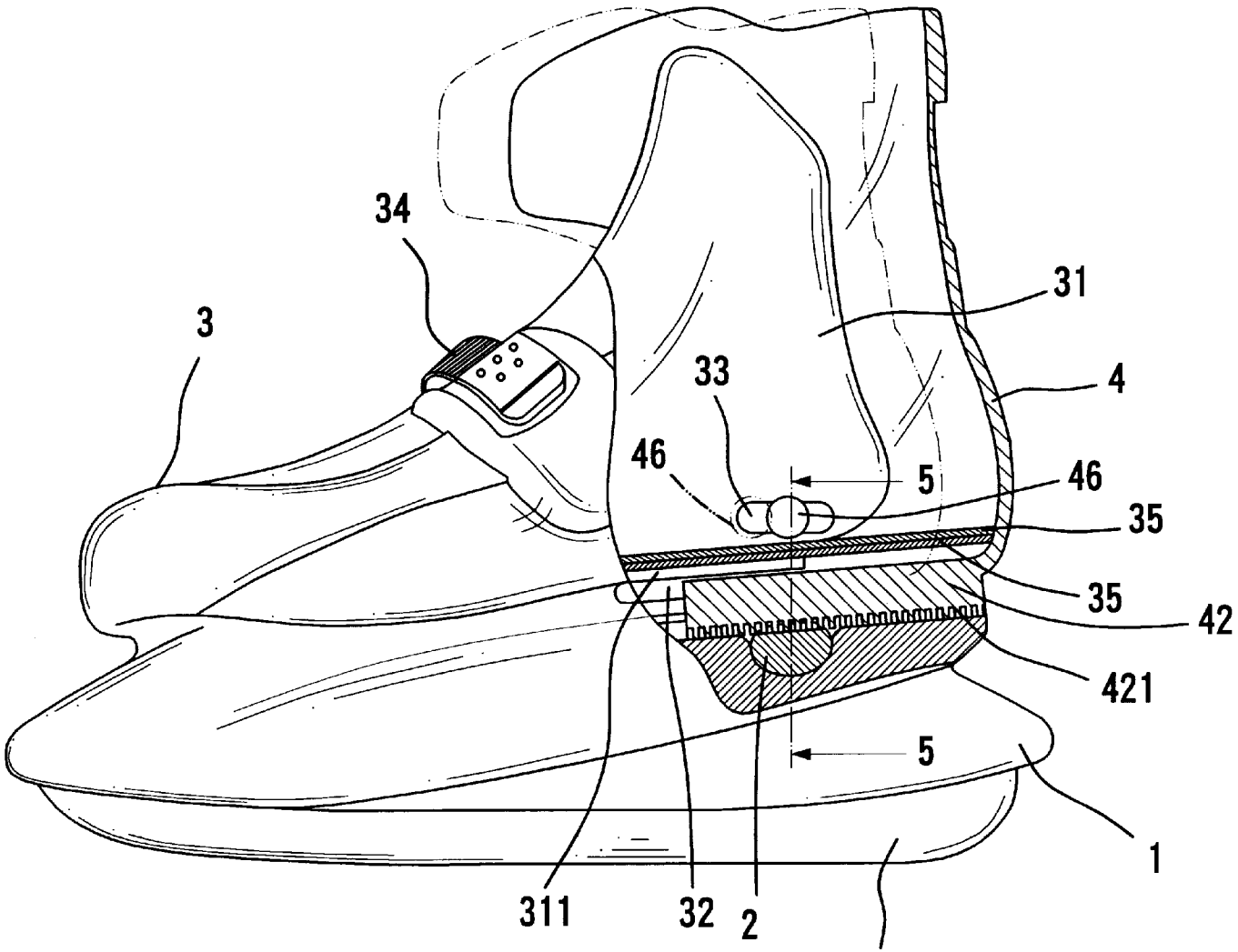
FIG. 4 is a view similar to FIG. 2, illustrating adjustment of the size of the boot.
Figure 5:
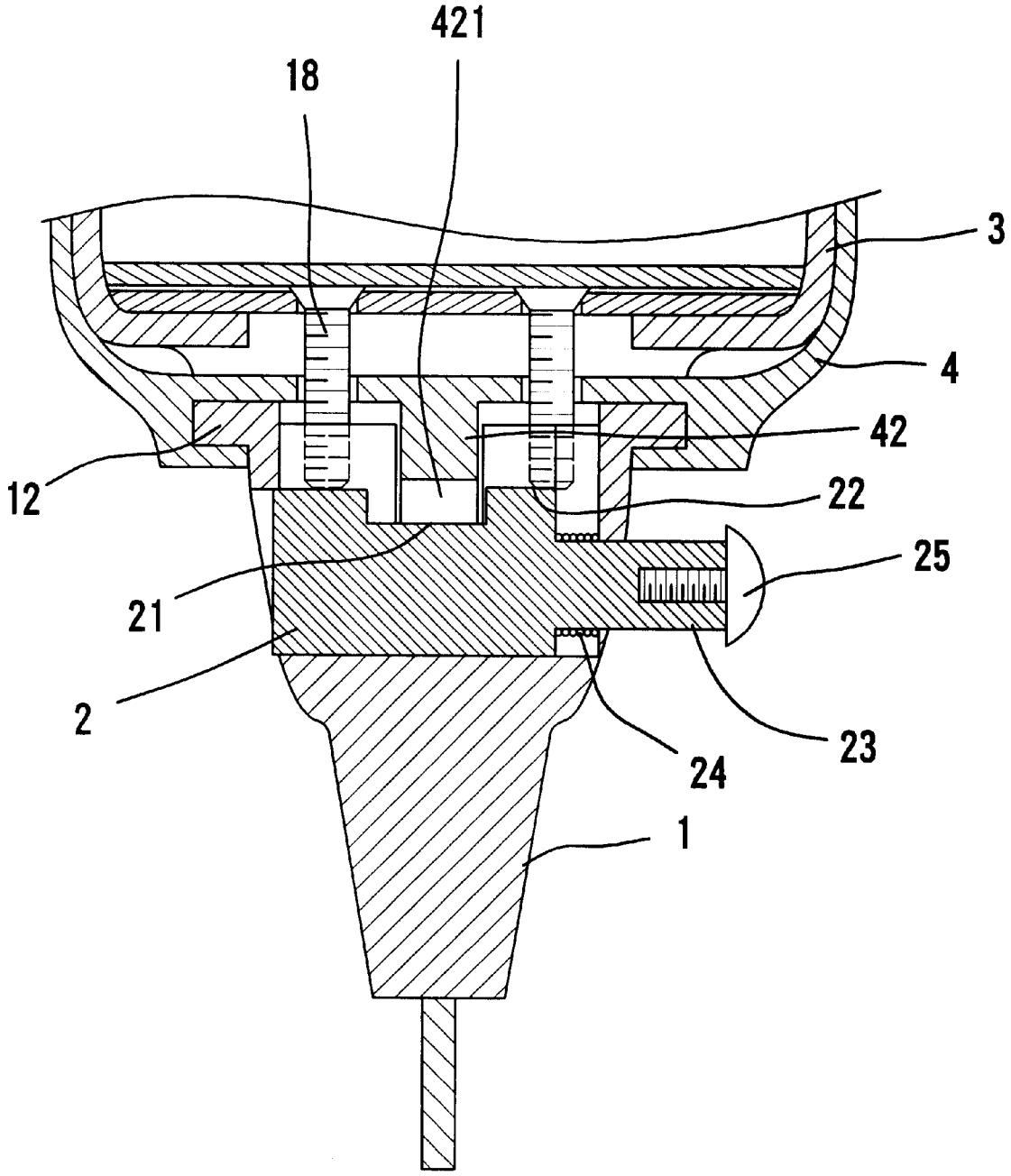
FIG. 5 is a sectional view taken along plane 5—5 in FIG. 4.

When adjusting the size of the boot, as illustrated in FIGS. 4 and 5, the adjusting member 2 is pushed such that the recessed portion 21 is moved to a position below the rack 42 and that the toothed portion 22 of the adjusting member 2 is disengaged from the teeth 421 of the rack 42. Thus, the rear portion 4 may slide along a longitudinal direction of the base 1. When the rear portion 4 of the boot reaches the desired position, the adjusting member 2 is released and returned to its initial position shown in FIG. 3 under the action of the spring 24. The toothed portion 22 of the adjusting member 2 reengages with the teeth 421 of the rack 42. In a case that the toothed portion 22 of the adjusting member 2 is not in a fully engaging relationship with the teeth 421 of the rack 42, the user may slightly move the rear portion 4, which allows the toothed portion 22 of the adjusting member 2 is the fully engaging relationship with the teeth 421 of the rack 42 under the action of the spring 24.

Referring to FIGS. 2 and 4, after the rear portion 4 of the boot is mounted to the rear of the front portion 3 of the boot, the holes 44 of the rear portion 4 are located inside and aligned with the slots 33 of the front portion 3. Each guide member 46 is securely mounted in an associated hole 44 of the rear portion 44 and extended into an associated slot 33 of the front portion 3, thereby guiding the sliding movement of the rear portion 4 relative to the front portion 3. The adjusting distance of the rear portion 44 is limited by the length of the slots 33. Another function of the slots 33 is to prevent excessive movement of the rear portion 4 that might cause disengagement of the rear portion 4 from the base 1.

Referring to FIG. 3, the base 1 may further include two positioning holes 17 in front of the receiving section 14 of the longitudinal groove 13. Fasteners 18 are extended through the slots 43 of the rear portion 4 and the positioning holes 17 after adjustment of the rear portion 4 is completed. Thus, the rear portion 4 is fixed in place.

According to the above description, when adjusting the size of the boot, the user pushes the adjusting member 2 and pulls the rear portion 4 of the boot rearward. Next, the user places his/her foot into the boot and then moves the rear portion 4 forward until it reaches an optimal position. The adjusting member 2 is then released, and the adjustment is finished. The buckle 45 clamps the rear portion 4 and the front portion 3 of the boot, providing a safe, comfort use of the skate.

Thus, the skate can be easily adjusted to suit the user's foot without adversely affecting the structural strength of the skate.

Although the invention has been explained in relation to its preferred embodiment, it is to be understood that many other possible modifications and variations can be made without departing from the scope of the invention as hereinafter claimed.

What is claimed is:

1. A skate comprising:

a base (1) including an upper side, a mounting section (11) being defined in a rear portion of the upper side, the mounting section (11) including two wings (12) and a longitudinal groove (13) between the wings, the longitudinal groove (13) including a receiving section (14) in a front end thereof, two lateral walls defining the longitudinal groove (13) including aligned first and second holes (15 and 16) that are communicated with the receiving section (14);

an adjusting member (2) including a first end partially received in the first hole (15), a second end (23) received in the second hole (16), and an intermediate portion received in the receiving section (14), the first end of the adjusting member (2) including a recessed portion (21), a toothed portion (22) being formed on the intermediate portion of the adjusting member (2), a spring (24) being mounted around the second end (23) of the adjusting member for returning the adjusting member to its initial position, a screw (25) being attached to the second end (23) of the adjusting member (2) for restraining returning movement of the adjusting member; and a boot comprising a front portion (3) and a rear portion (4), the front portion (3) being provided on the upper side of the base (1) and including an open rear end (31) located in a front end of the mounting section (11), a slot (32) being defined between a bottom of the open rear end (31) and each of the wings (12);

the rear portion (4) of the boot being mounted to the mounting section (11) of the base (1) and adjustable along a longitudinal direction of the base (1), the rear portion (4) of the boot including an open front end for embracing the rear end (31) of the front portion (3) of the boot, thereby forming a boot, the rear portion (4) of the boot further including two slide grooves (41) in an underside thereof for respectively, slidingly receiving the wings (12) of the base (1), the rear portion (4) of the boot further including a rack (42) received in the longitudinal groove (13) and located between the slide grooves (41), the rack (42) including a plurality of teeth (421) for engaging with the toothed portion (22) of the adjusting member (2);

when the adjusting member (2) is in its initial position, the toothed portion (22) of the adjusting member (2) is engaged with the teeth (421) of the rack (42), thereby securing the rear portion (4) of the boot in place; and when the adjusting member (2) is pushed, the toothed portion (22) of the adjusting member (2) is disengaged with the teeth (421) of the rack (42), thereby allowing the rear portion (4) of the boot to move along the longitudinal direction of the base (2).

2. The skate as claimed in claim 1, wherein the recessed portion (21) of the adjusting member (2) is moved to a position below the rack (42) when the adjusting member (2) is pushed.

3. The skate as claimed in claim 1, wherein the open rear end (31) of the front portion (3) of the boot includes two parallel walls having aligned slots (33) defined therein, the front end of the rear portion (4) of the boot including two parallel walls having aligned holes (44), further comprising two guide members (46) each of which is fixed in an associated one of the holes (44) of the rear portion (4) of the boot, each of the guide members (46) being slidably received in an associated one of the slots (33) of the front portion (3) of the boot.

4. The skate as claimed in claim 1, wherein the rear portion (4) of the boot includes a bottom having two slots (43), the base (1) further including two positioning holes (17) in front of the receiving section (14) of the mounting section (11), further comprising fasteners (18) extending through the slots (43) of the rear portion (4) of the boot and the positioning holes (17) of the base (1).

* * * * *